United States Patent [19]

DenHerder

[11] Patent Number: 4,696,638

[45] Date of Patent: Sep. 29, 1987

[54] OIL FUEL COMBUSTION

[76] Inventor: Marvin J. DenHerder, 816 Brookwood Dr., Olympia Fields, Ill. 60461

[21] Appl. No.: 882,806

[22] Filed: Jul. 7, 1986

[51] Int. Cl.[4] ..... F23J 7/00; C10L 1/32

[52] U.S. Cl. ..... 431/4; 44/51

[58] Field of Search ..... 431/2, 4; 44/51; 123/25 R, 25 A, 25 B; 60/39.05, 39.53, 39.58, 39.59; 366/150; 252/312

[56] References Cited

U.S. PATENT DOCUMENTS 3,749,318 7/1973 Cottell ..... 431/4 X 3,766,942 10/1973 Delatronchette et al. ..... 431/4 X 4,116,610 9/1978 Berthiaume ..... 431/4

4,416,610 11/1983 Gallagher ..... 431/4

4,618,348 10/1986 Hayes et al. ..... 44/51

*Primary Examiner*—Margaret A. Focarino

*Attorney, Agent, or Firm*—Philip Hill

[57] ABSTRACT

Improved combustion efficiency is achieved by separately preparing a water-in-oil emulsion, containing up to about 90 volume % water, and blending the emulsion into an oil fuel prior to combustion. The blended oil fuel contains from 1 to about 10 vol. % water in the form of tiny droplets having a diameter within the range from about 1 to about 10 microns. The process of this invention may be applied to heating systems, steam boilers, gas turbines, rotary kilns, and internal combustion engines, including diesel engines.

23 Claims, 2 Drawing Figures

OIL FUEL COMBUSTION

BACKGROUND

This invention relates to a process for the improved combustion of oil fuels which may include hydrocarbon oils, vegetable or plant oils, oil-coal slurries, and the like. Improved combustion is accomplished by incorporating a minor proportion of a separately prepared water-rich water-in-oil emulsion into a fuel prior to combustion, thus providing an optimized proportion of water present in the fuel as tiny droplets having a diameter within the range from about 1 to about 10 microns.

The benefits from the inclusion of water in fuels employed in furnaces, internal combustion engines, and gas turbines have been observed over many years and reported by many investigators. For example, *Proceedings of the 16th International Symposium on Combustion,* 1976, Combustion Institute, discusses water addition to fuels in papers appearing at pages 279–295, 297–305, 307–319, and 321–336, and presented by F. L. Dryer, A. Sjogren, M. T. Jacques et al., and G. Greeves et al., respectively.

The Dryer paper pointed out that the addition of water may have both physical and chemical kinetic effects. In spark ignition engines pre-ignition and detonation can be reduced. For furnace fuels, water shortens combustion time and improves the completeness of combustion. Applications to diesel engines, gas turbines and industrial boilers are discussed, employing up to 25 volume % water and 3% of surfactant (emulsifier). The Jacques, et al., paper reported on the addition of up to 15 volume % water together with asphaltenes. Carbonaceous residues were greatly reduced, presumably due to a lesser degree of thermal cracking during combustion of the subject fuels. The Greeves, et al., paper reported on diesel engine performance, noting a reduction in $NO_x$ production during combustion when water injection with the fuel was employed. Water/fuel volume ratios varied from 0.21 to 0.80, or 17.3 to 44.4 volume % water.

In general, the reported positive effects from addition of water to fuels include reduced fuel consumption, cleaner exhausts, cleaner boiler tubes, less luminosity and shorter flame length. Further substantiation is found in a recent report (March, 1985) from The Adelphi Research Center, Inc. where the addition of 10 volume % water to #6 residual fuel was studied in boiler furnaces.

Generally, these reports have found that large amounts of water, ranging from 10 to 40 volume %, are required to obtain significant reductions in carbon emissions and in improved combustion performance. One exception is the cited report by A. Sjogren who demonstrated that less water is required for significant combustion improvement where the water is more finely dispersed in the oil, preferably as particles having diameters in the range from 2 to 5 microns. This permitted the use of only 2–3 volume % water while substantially eliminating oil coke in the boiler emissions. Dispersion of water droplets in the oil fuel was effected by repeated and intense mechanical treatments, including ultrasonic homogenizing, mechanical homogenizing, or centrifugal pumping. Inclusion of a surfactant was also employed.

The ultrasonic formation of water-in-oil dispersions, with no added emulsifying agent, for use in burners is further described in U.S. Pat. No. 3,749,318. Similar usage of Venturi systems is disclosed in U.S. Pat. Nos. 3,937,445 and 4,416,610.

The prior art processes requiring the inclusion of some 10 to 40 volume % water in the oil fuel have not been widely employed because of significant problems. Additional heat is required to vaporize the large amounts of water, thus reducing furnace efficiency. Additional costs are incurred in the delivery and storage of emulsified fuels. Other problems include corrosion of storage facilities, stratification of the emulsion, and water separation. Corrosion, wear and damage to fuel system components is more serious where water is added to fuels employed in internal combustion engines.

The benefits attributed to combustion where only 2–3 volume % water is added to the fuel were obtained only when either multiple pass emulsification or intensive emulsification in the presence of an added agent was employed. Energy consumed in such emulsification and additional costs for specialized equipment and/or large proportions of emulsifying agents detract from the attractiveness of this approach to providing tiny droplets of water in the large volume of oil fuel to the combustion zone.

SUMMARY OF THE INVENTION

This invention relates to a process for the improved combustion of oil fuels in a combustion zone selected from among heating furnaces, steam boilers, gas turbines, rotary kilns, and internal combustion engines, including diesel engines. Improved combustion is effected by preparing a water-in-oil emulsion containing up to about 90 volume % water as tiny droplets having individual diameters of from about 1 to about 10 microns; blending the emulsion into a larger body of oil fuel to provide a combustion feedstock containing from about 1 to about 10 volume % water; and effecting improved combustion, characterized by improved energy efficiency and a cleaner, ecologically desirable effluent gas stream.

This invention further relates to the first formation of the water-in-oil emulsion in a combustible carrier fluid which is readily miscible with the oil fuel and can be subsequently added thereto.

This invention additionally relates to the use of a pre-heated oil fuel, optionally heated by steam or by exhaust gases from the combustion zone, to reduce the viscosity of the oil fuel for improved burner performance in the energy-producing system.

This invention also relates to apparatus for the preparation of the water-in-oil emulsion and for its metered introduction into the body of the oil fuel prior to combustion.

DESCRIPTION OF THE INVENTION

Figure 1:
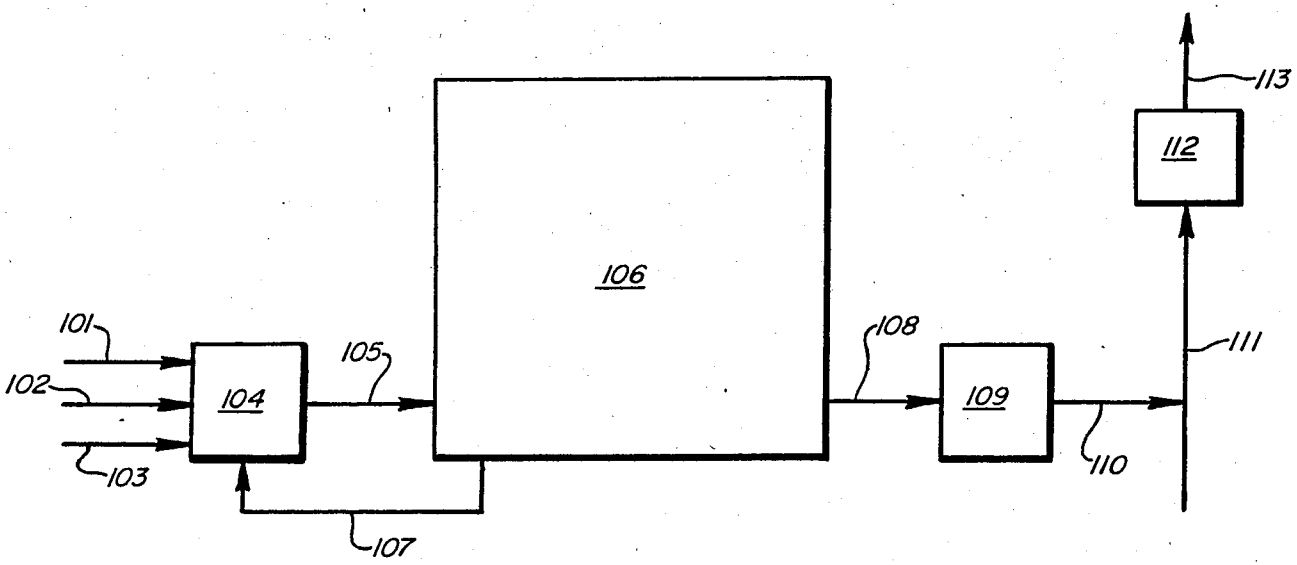
FIG. 1 provides a schematic arrangement illustration of the process of this invention.

This invention relates to a novel process for the improved combustion of oil fuels and to an improved system for the preparation of stable water-in-oil emulsions for use in said process. Improved combustion efficiency is achieved by separately preparing a water-in-oil emulsion and mixing this emulsion into a larger body of oil fuel prior to its introduction into a combustion zone. This invention further relates to an arrangement of apparatus peculiarly effective for the preparation and subsequent metering of the water-in-oil emulsion.

The novel process of this invention may be employed generally in the combustion of oil fuels which include hydrocarbon oils, vegetable oils, plant oils, oil-coal slurries, and mixtures of these. The novel process is particularly useful in the combustion of fuels comprising kerosene, diesel fuels, furnace oils, residual fuels, and mixtures of any or all of these. Further, the novel process of this invention is intended for use generally in oil-fired furnaces, steam boilers, gas turbines, rotary kilns, and internal combustion engines, including both spark-ignition and compression-ignition, or diesel, engines.

In the process of this invention, the water-in-oil emulsion is prepared by incorporating from about 20 to about 90 volume % water into a combustible oil carrier fluid. The carrier fluid should be separately compatible with the oil fuel intended for injection into the combustion zone. Suitable combustible oil carrier fluids include the oil fuel, which may require heating, as well as lighter oils such as kerosene, furnace oil, unsaturated fatty oils, and mixtures of these. Suitable fatty oils, or glycerides, include triolein and glyceryl trilinoleate. Preferred water-in-oil emulsions contain from about 30 to about 70 volume % water, while particularly preferred emulsions contain about 50 volume % water. The water contained in any of these emulsions is present in the form of a fine dispersion of tiny droplets having a diameter within the range from about 1 to about 10 microns, preferably from about 1 to about 5 microns, and most preferably from about 2 to about 4 microns. Where desired, there may be additionally employed a surface-active, or emulsifying, agent, preferably an oil-soluble, or oleophilic, agent to reduce the amount of energy required for emulsification and to stabilize the water-in-oil emulsion.

Incorporation of the highly concentrated water-in-oil emulsion into the body of the oil fuel is accomplished by metering into the oil fuel a pre-determined proportion of emulsion to provide in the fuel a quantity of water within the range from about 1 to about 10 volume %, preferably from about 2 to about 4 volume %, still maintained in the fine degree of dispersion set forth above.

It is believed that the size of the water droplets and the number of such droplets are important considerations in the effectiveness of the process of this invention. Without in any manner being bound thereby, the prior art has suggested that water assists in the combustion of oil fuels by exploding as it converts to vapor at the high temperatures present in the combustion zone. This, in turn, causes the oil drops to burst into smaller particles which burn more efficiently. The prior art has suggested that there must be at least 2 volume % water (as preferred in this invention) inside an oil drop to supply enough energy from the water vapor to explode the oil drop. There must also be a sufficient number of water droplets dispersed in the fuel to afford at least one water droplet contained in most of the larger oil fuel drops as the fuel drops are injected into the combustion zone. Table I presents a correlation of water/fuel volume, as a function of respective droplet diameters, that must be emulsified to provide an equal number of water and fuel droplets. For example, where water is emulsified to provide droplets having a diameter of 4 microns, 0.016 volume parts (1.6 volume %) water are required to have one such water droplet available for each fuel droplet having a diameter of 16 microns. When the laws of probability are applied to this situation, about 35% of the fuel droplets are calculated to have no water. In order to have water present in at least 90% of the fuel droplets, it has been determined that probability requires about a 2.5-fold excess of water droplets over oil fuel droplets. In the present example, this would require that 4 volume % water be present to attain such a goal.

It is difficult to disperse and stabilize such tiny droplets of water in the fuel to the exclusion of large droplets. In the above example where it was determined that 4 volume % of 4 micron diameter water droplets was desirable, the presence of only 10% water droplets having a 12 micron diameter would require a 4-fold increase in the total amount of water present. Efficiency of combustion would thereby be reduced since 1% more fuel is required to vaporize 12% water in the fuel fed to the combustion zone.

When water is dispersed in low viscosity fuels, such as kerosene or distillate fuels, for injection into gas turbines or internal combustion engines, stratification and emulsion separation make water content and particle size control a difficult problem. The entire fuel system, including pumps, filters, and injectors exhibit corrosion, blockages, wear, and early failure, unless only very tiny water droplets (diameter smaller than 2 microns) are injected and the wet fuel is inhibited against corrosion and wear.

The process of this invention avoids such problems, and the attendant costs, by preparing an emulsion concentrate easily tailored for the selected application. Where needed, an emulsifying agent may be employed to facilitate formation and to stabilize the emulsion. Microscopic examination of the emulsion concentrate can be utilized to determine the size of water droplets and guide adjustments in the intensity of emulsification.

In the process of this invention, the carrier fluid, employed in preparing the emulsion concentrate, may be the fuel to be burned. For higher viscosity fuels, emulsion formation and handling are aided by first heating the fuel and maintaining the emulsion at a temperature within the range from about 150° to about 200° F. When viscous fuels are burned, they are often heated to from about 150° to about 200° F. to lower the viscosity and to improve the combustion, or burner, performance. When the burner fuel is heated, the emulsion concentrate can also be heated, prior to blending with fuel, to maintain the desired fuel temperature at the burner.

The process of this invention is generally set forth in FIG. 1. Water, combustible carrier fluid, and emulsifying agent, as required, are introduced through respective lines 101, 102, and 103 to emulsifier 104. The resulting emulsion is passed therefrom through line 105 into holding tank 106. The emulsion can be cycled back to the emulsifier through line 107, employing pumping means, not shown. Microscopic means, not shown, are employed to determine the character of the emulsion in holding tank 106 and the possible need for more intense or extensive emulsification. As required, emulsion is directed from tank 106 through line 108, meter 109 and line 110 into line 111 delivering oil fuel for combustion. The emulsion and oil fuel pass together through a final section of line 111 into blender 112. The blended emulsion and oil fuel is then delivered through line 113 to either a storage zone or combustion zone, not shown. In a preferred embodiment of this process, the blended emulsion and oil fuel is injected directly into the combustion zone.

Figure 2:
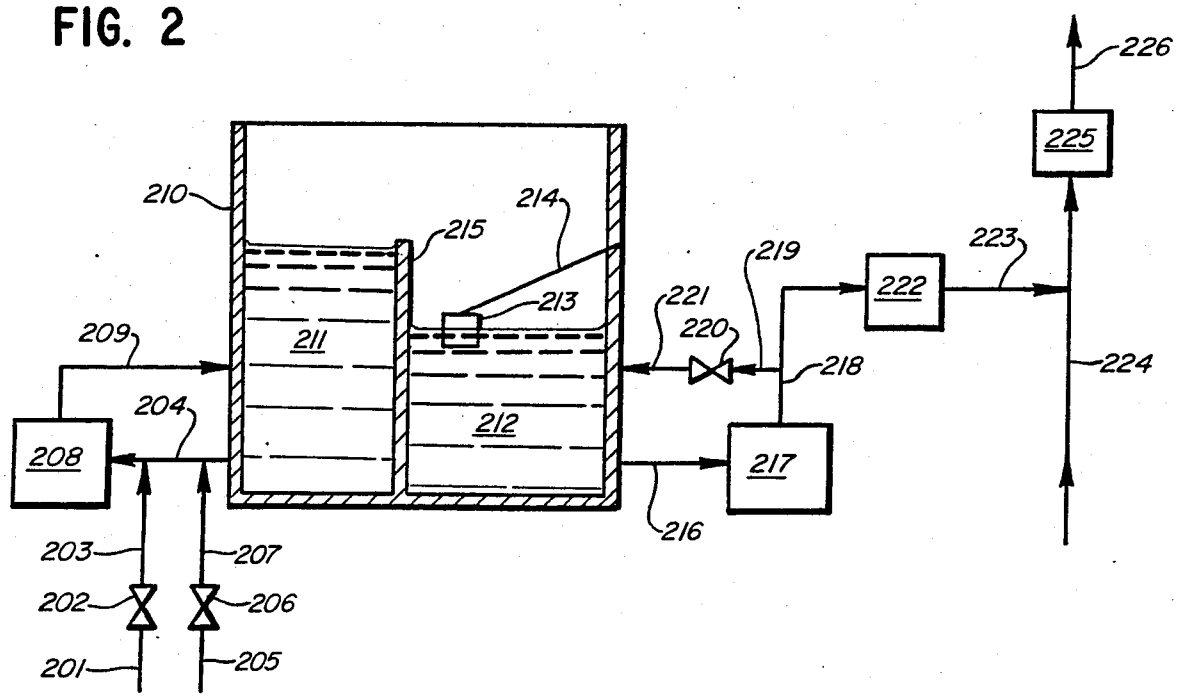
FIG. 2 illustrative of one preferred embodiment of the emulsification apparatus of this invention.

One preferred embodiment of the emulsification system of this invention is presented in FIG. 2. Carrier fluid (together with emulsifier additive) is metered through line 201, solenoid valve 202, and lines 203 and 204 into emulsifier 208. Water is similarly added through line 205, solenoid valve 206, and lines 207 and 204 into emulsifier 208. The water-in-oil emulsion is directed through line 209 to storage vessel 210, specifically to storage compartment 211, employing pumping means, not shown. The emulsion is regularly recycled from compartment 211 through line 204, emulsifier 208, and line 209. When compartment 211 is filled, emulsion spills over retainer wall 215 into storage compartment 212 where the level of emulsion is regularly monitored, as for example, by float 213, attached to movable arm 214. Solenoid valves 202 and 206 are opened and closed remotely by a signal mechanism, not shown, actuated by the position of float 213. Emulsion from compartment 212 is recycled regularly through line 216, emulsifier 217, and lines 218 and 219, pressure control valve 220, and line 221. When required for use as a fuel component, emulsion is withdrawn through line 218, meter 222, and line 223 for introduction into line 224 carrying oil fuel. The combined emulsion and oil fuel passes through line 224, mixer 225, and line 226 into the combustion zone, not shown.

The following example is illustrative, without limitation, of the process of this invention.

EXAMPLE I

Water-in-oil emulsion was prepared employing an emulsion preparation and injection system conforming generally to the configuration presented in FIG. 1, employing conventional pumping and combustion equipment. A mixture of 25 gallons kerosene and 25 gallons water, together with 0.12 gallons of emulsifying additive, was added to the emulsion holding tank and continuously circulated through the emulsifier for 1.5 hours to form the microemulsion of water in oil. A spare conventional boiler in stand-by use was fired at a feed rate of 500 gallons per hour of #6 fuel oil (otherwise known as bunker "C" or residual fuel oil) previously heated to 190°–200° F. Emulsion was metered into the fuel oil feed line at rates varying from 0.7 to 1.5 volume % water. Blending of emulsion and fuel was effected by passage through a series of four right-angle bends in the feed line.

Water injection was effected smoothly during tests over a one-month period. However, the intermittent firing of the stand-by boiler did not permit sufficiently accurate measurement of fuel conservation.

EXAMPLE II

The water-in-oil emulsion preparation and injection system employed in Example I was connected to the fuel feed line of a 40,000 lb./hr. steam boiler burning #6 fuel oil during alternate 12-hour on and off periods. Feed rate was 250 gal./hr. of fuel oil preheated to 185°–190° F. in normal operation and to 195°–200° F. when water injection was employed. Emulsion, prepared as in Example I, was metered into the fuel oil feed line at rates varying from 1.0 to 2.5 volume % water with most tests being conducted at a rate of 1.7 volume %.

In tests conducted over a period of four months, fuel consumption was reduced on the average by 2.5% when employing emulsion injection.

TABLE I

VOLUME RATIO OF WATER TO FUEL*

| Water Droplet Diameter, microns | Fuel Droplet Diameter, microns | | | | | |
|---|---|---|---|---|---|---|
| | 1 | 2 | 4 | 8 | 16 | 30 |
| 1 | 1 | 1.125 | 0.016 | 0.002 | 0.0002 | $1 \times 10^{-5}$ |
| 2 | — | 1 | 0.125 | 0.016 | 0.002 | $3 \times 10^{-4}$ |
| 4 | — | — | 1 | 0.125 | 0.016 | 0.002 |
| 6 | — | — | — | 0.42 | 0.053 | 0.008 |
| 8 | — | — | — | 1 | 0.125 | 0.019 |
| 10 | — | — | — | — | 0.24 | 0.037 |

*To provide equal numbers of water and oil droplets

I claim:

1. A process for the improved combustion of oil fuels in a combustion zone, comprising the steps of:

(a) preparing a water-in-oil emulsion in a combustible oil carrier fluid, said water-in-oil emulsion containing from about 20 to about 90 volume % water present as droplets having a diameter within the range from about 1 to about 10 microns;

(b) thereafter blending the water-in-oil emulsion into the fuel in a proportion selected to provide a water content dispersed in the fuel within the range from about 2 to about 10 volume %; and (c) introducing the blended fuel to the combustion zone.

2. The process of claim 1 wherein the oil fuel comprises a hydrocarbon oil fuel.

3. The process of claim 1 wherein the oil fuel comprises a vegetable oil fuel.

4. The process of claim 1 wherein the oil fuel comprises a plant oil fuel.

5. The process of claim 1 wherein the oil fuel comprises an oil-coal slurry.

6. The process of claim 2 wherein the hydrocarbon oil fuel is selected from the class consisting of kerosene, diesel fuel, furnace oil, residual oil, and mixtures thereof.

7. The process of claim 1 wherein the combustion zone comprises a furnace heating system.

8. The process of claim 1 wherein the combustion zone comprises a steam boiler.

9. The process of claim 1 wherein the combustion zone comprises a gas turbine.

10. The process of claim 1 wherein the combustion zone comprises a rotary kiln.

11. The process of claim 1 wherein the combustion zone comprises a diesel engine.

12. The process of claim 1 wherein the combustible oil carrier fluid is selected from the class consisting of kerosene, furnace oils, unsaturated fatty oils, and mixtures thereof.

13. The process of claim 1 wherein the water-in-oil emulsion contains from about 30 to 70 volume % water.

14. The process of claim 13 wherein the water-in-oil emulsion contains about 50 volume % water.

15. The process of claim 1 wherein the water in the water-in-oil emulsion is present substantially as droplets having a diameter within the range from about 1 to about 5 microns.

16. The process of claim 15 wherein the water in the water-in-oil emulsion is present substantially as droplets having a diameter within the range from about 2 to about 4 microns.

17. The process of claim 1 wherein the water-in-oil emulsion is additionally stabilized by the addition to the preparation step (a) of an effective proportion of an emulsifying agent.

18. The process of claim 1 wherein the oil fuel is maintained at a temperature within the range from about 150° to about 200° F. during the blending operation of step (b).

19. The process of claim 1 wherein the blended oil fuel contains water dispersed therein in an amount within the range from about 2 to about 4 volume %.

20. The process of claim 1 wherein the water-in-oil emulsion is additionally held in a storage zone prior to blending into the hydrocarbon oil feedstock.

21. The process of claim 1 wherein the blended hydrocarbon fuel is additionally maintained in a storage zone prior to being introduced into the combustion zone.

22. Apparatus, for the improved preparation of water-in-oil emulsions for use in the combustion of oil fuels in a combustion zone, said emulsions containing water droplets having an average diameter within the range from about 1 to about 10 microns, comprising:

(a) an emulsification vessel, affording means for the preparation of a water-in-oil emulsion;

(b) separate metered lines for feeding, respectively water, combustible oil carrier fluid, and emulsification additive to the emulsification vessel;

(c) an emulsion holding tank;

(d) cycling means for the circulation of water-in-oil emulsion between the emulsification vessel and the emulsion holding tank;

(e) an oil fuel blending zone;

(f) first delivery means, for the metered delivery of the water-in-oil emulsion to the oil fuel blending zone; and (g) second delivery means, for the transfer of blended emulsion and oil fuel from the blending zone to the combustion zone, or optionally, to an intermediate storage zone.

23. The apparatus of claim 22, wherein the emulsion holding tank includes a first holding zone, for circulation of emulsion between the emulsification vessel and the first holding zone, together with a second holding zone, separately fitted with cycling means, connected to the first delivery means, the emulsion being transferred from the first holding zone to the second holding zone by an intermediate transfer means responsive to level control means situated within the second holding zone.

* * * * *